US005788484A

United States Patent [19]

Melgaard et al.

[11] Patent Number: 5,788,484

[45] Date of Patent: Aug. 4, 1998

[54] RAPID CYCLE TREATMENT OVEN

[75] Inventors: Hans L. Melgaard, North Oaks; Louis A. Larson, Golden Valley, both of Minn.

[73] Assignee: Despatch Industries Limited Partnership

[21] Appl. No.: 496,464

[22] Filed: Jun. 29, 1995

[51] Int. Cl.[6] ..... F24J 3/00; F27D 13/00

[52] U.S. Cl. ..... 432/227; 434/4; 434/202

[58] Field of Search ..... 432/1, 4, 11, 18, 432/31, 54, 200, 202, 227, 175, 176, 209, 225, 81; 126/92 C

[56] References Cited

U.S. PATENT DOCUMENTS

| | | | |
|---|---|---|---|
| 2,651,271 | 9/1953 | Naylor | 432/176 |
| 2,961,976 | 11/1960 | Ooms | 432/176 |
| 3,920,383 | 11/1975 | Kerr | 432/223 |
| 4,218,211 | 8/1980 | Caplan | 432/219 |
| 4,480,628 | 11/1984 | Simpson | 126/92 C |
| 4,740,158 | 4/1988 | Johnson | 432/59 |
| 5,100,502 | 3/1992 | Murdoch et al. | 156/643 |
| 5,273,588 | 12/1993 | Foster et al. | 118/723 E |
| 5,552,955 | 9/1996 | Mashiro et al. | 361/234 |

*Primary Examiner*—William Doerrler
*Attorney, Agent, or Firm*—Fredrikson & Byron, PA

[57] ABSTRACT

The invention provides an oven which can be used to rapidly heat and cool a workpiece. In one embodiment, the oven includes a first duct which defines an initial leg of an enclosed air flow path and which has an inner panel and a heat exchanger. This first duct has an inlet end and an outlet end, the inlet end of which is connected to a temperature-controlled air supply. The oven also includes a second duct which defines a final leg of the enclosed air flow path and which has an inner panel spaced from the first duct's inner panel to define an oven cavity. The oven also has a connecting conduit connecting the outlet end of the first duct to the second duct and which defines an intermediate leg of the enclosed air flow path. In a preferred embodiment, the first duct is the lower of the two ducts and includes a plurality of holes through at least the inner panel of the duct. A plurality of selectively actuatable lifting pins extend through these holes in the first duct and the pins are adapted to lift a workpiece upwardly off of the inner panel.

8 Claims, 4 Drawing Sheets

RAPID CYCLE TREATMENT OVEN

FIELD OF THE INVENTION

The present invention generally relates to industrial heat treatment ovens, and, more particularly, provides a novel oven for rapidly cycling heat treatment temperatures within an enclosure.

BACKGROUND OF THE INVENTION

In processing a variety of piece goods, one frequently must subject the work in process to a specific heat treatment to achieve certain properties in the finished article. There is a wide variety of equipment available on the market to achieve various heat treatment profiles for different types of work pieces. The temperature parameters and size of the equipment necessary for a particular manufacturing process will depend on the nature of the heat treatment and the size of the work pieces to be treated.

In most heat treatment processes, it is necessary to heat the work pieces to a given temperature, hold at that temperature for a predetermined period of time, and cool the work piece back down. In many processes, the rate of heating and cooling is critical and often must be carried out at a relatively slow pace to avoid damage to the work piece. In other processes, though, the rate at which the work piece is heated or cooled is not as important as the final temperature reached and the time the work piece stays at that temperature.

In the latter process, heating and cooling rates can be a significant factor in the cost of the final article. If it takes a relatively long time to heat the work piece to the treatment temperature and to cool it back down, the throughput of the manufacturing facility can become dependent on the throughput of the heat treatment equipment. In order to increase throughput, and hence decrease manufacturing costs, the manufacturer will have to increase the number of heat treatment units. This can involve significant capital expenditures in terms of both the equipment and the additional factory floor space needed for the equipment.

Even if the costs of additional heat treatment units would not be significant, in some instances, it can still be greatly advantageous to speed the heat treatment process. In producing many products, there are several stages in the manufacturing process and some form of heat treatment is necessary between each stage. In the manufacture of multi-layer electronic components, for example, one layer is successively applied after another to create a final component with the desired circuitry or properties. Each layer often has to be heat treated in some fashion to yield a layer with the desired chemical and electrical properties. In such circumstances, the equipment used to precisely apply each successive layer can be quite expensive. If the time spent outside that equipment during heat treatment can be minimized, the utilization of this equipment can be maximized, reducing the unit cost of the final components.

Providing a heat treatment system which can rapidly cycle up to the treatment temperature, hold the work piece at that temperature for the necessary time, and cool back down can therefore provide significant commercial advantages. It is therefore an object of one embodiment of the present invention to provide a system which can relatively rapidly heat and cool a work piece to minimize the time spent heating up to or cooling down from the desired treatment temperature.

SUMMARY OF THE INVENTION

The present invention provides an oven for rapidly heating and cooling a work piece. The oven includes first and second ducts, with a connecting conduit connecting these two ducts, the ducts and the conduit defining an enclosed air flow path. The first duct defines the initial leg of the enclosed air flow path and has an inner panel and a heat exchanger. An inlet end of the first duct is connected to a temperature-controlled air supply, which preferably is capable of passing heated or relatively cool air through the enclosed air flow path at a relatively rapid rate. The second duct defines the final leg of the enclosed air flow path and includes an inner panel spaced from the inner panel of the first duct to define an oven cavity therebetween. The connecting conduit connects the outlet end of the first duct to an end of the second duct and defines an intermediate leg of the enclosed air flow path.

In a preferred embodiment, the first duct comprises an outer panel which is spaced from the inner panel, the heat exchanger comprising a corrugated sheet disposed between the inner and outer panels and defining a plurality of air flow paths extending from the inlet end to the outlet end of the first duct. The second duct optimally comprises an inner panel, an outer panel and a pair of opposed side panels, the inner, outer and side panels defining an open chamber through which air may flow freely. In particular, the second duct desirably does not include a heat exchanger such as that carried in the first duct.

In a further embodiment of the invention, the first duct includes at least two lifting pins extending through its inner panel. These lifting pins are adapted to lift a work piece upwardly off of the inner panel so that the work piece can be removed from the first duct more readily. The pins are optimally received in ports which extend through the entire thickness of the first duct and are connected to a lifting system for synchronously raising the pins together. This lifting system may comprise a lifting plate, each of the pins being connected to the lifting plate so that when the lifting plate is raised or lowered the pins will all rise or lower together. In another embodiment of the lifting system, each of the pins is attached to a lifting cam which can raise a pin when the lifting cam is rotated.

DETAILED DESCRIPTION OF THE PREFERRED EMBODIMENTS

Figure 1:
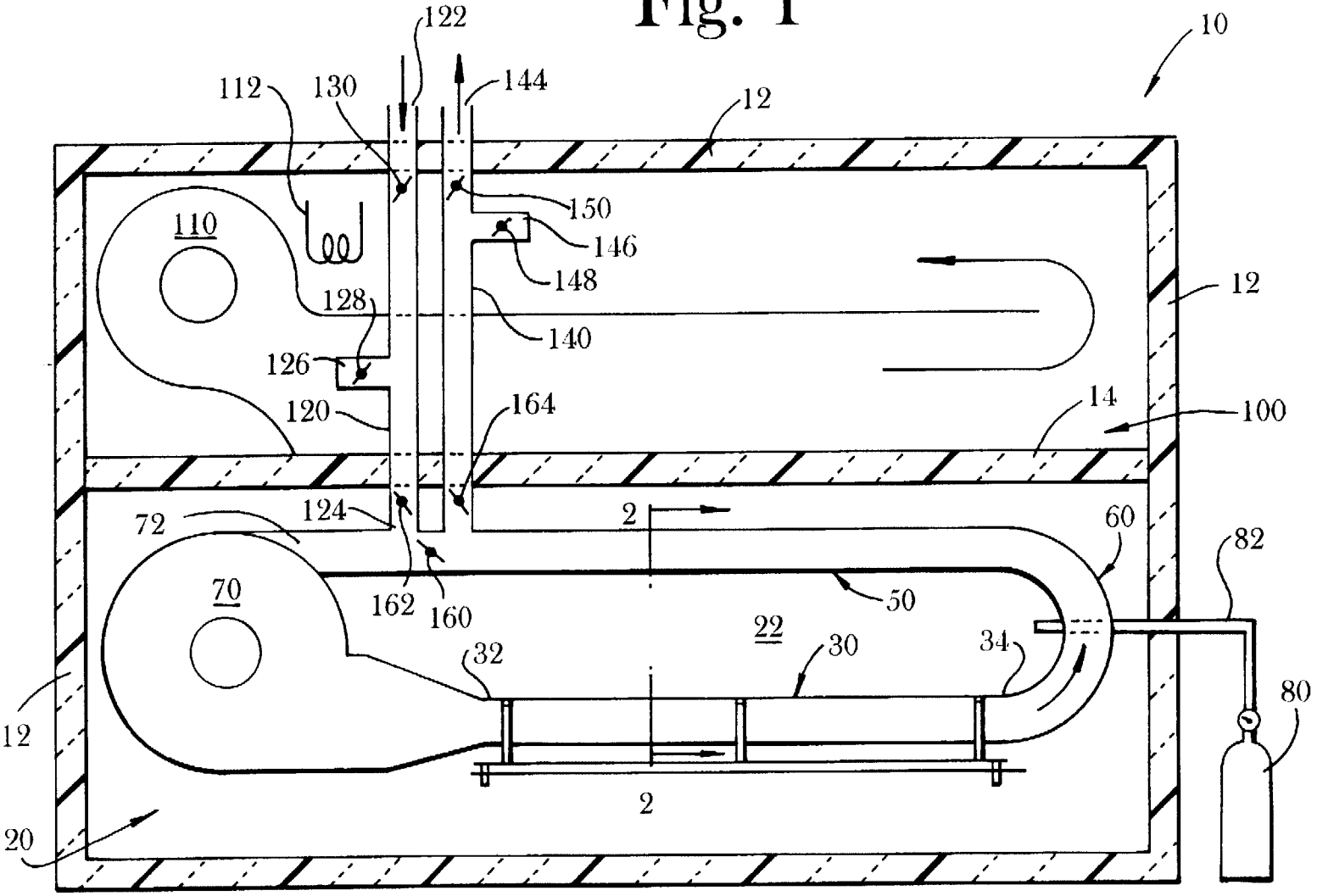
FIG. 1 is a schematic cross sectional view of an oven of the invention.

FIG. 1 schematically illustrates an oven 10 in accordance with the invention. The oven generally includes a heating chamber 20 and an air supply chamber 100, which are desirably surrounded by an exterior insulating wall 12 and separated by an insulating barrier 14. Only one such oven is shown in FIG. 1. If so desired, one may place one of these ovens on top of or immediately adjacent to another oven 10 (not shown). In such a circumstance, the two ovens can share an adjoining length of the insulating wall 12, which will serve to help thermally insulate one oven from the other.

Within the heating chamber is an oven cavity 22 generally surrounded by an enclosed air recirculation loop. The air recirculation loop is made up of a lower duct 30 which defines a first leg of the air flow path, a connecting conduit 60 which defines an intermediate leg of the air flow path, an upper duct 50 which defines a final leg of the air flow path, and a blower 70. Air is circulated through the loop, desirably at relatively high flow rates, by the blower. The air exiting the blower is maintained at a controlled temperature (in a manner described below) and directed into an inlet end 32 of the lower duct. The air passes through the lower duct and flows through the connecting conduit 60 to the upper duct 50. The upper duct returns the air to the blower 70, completing the loop.

Figure 2:
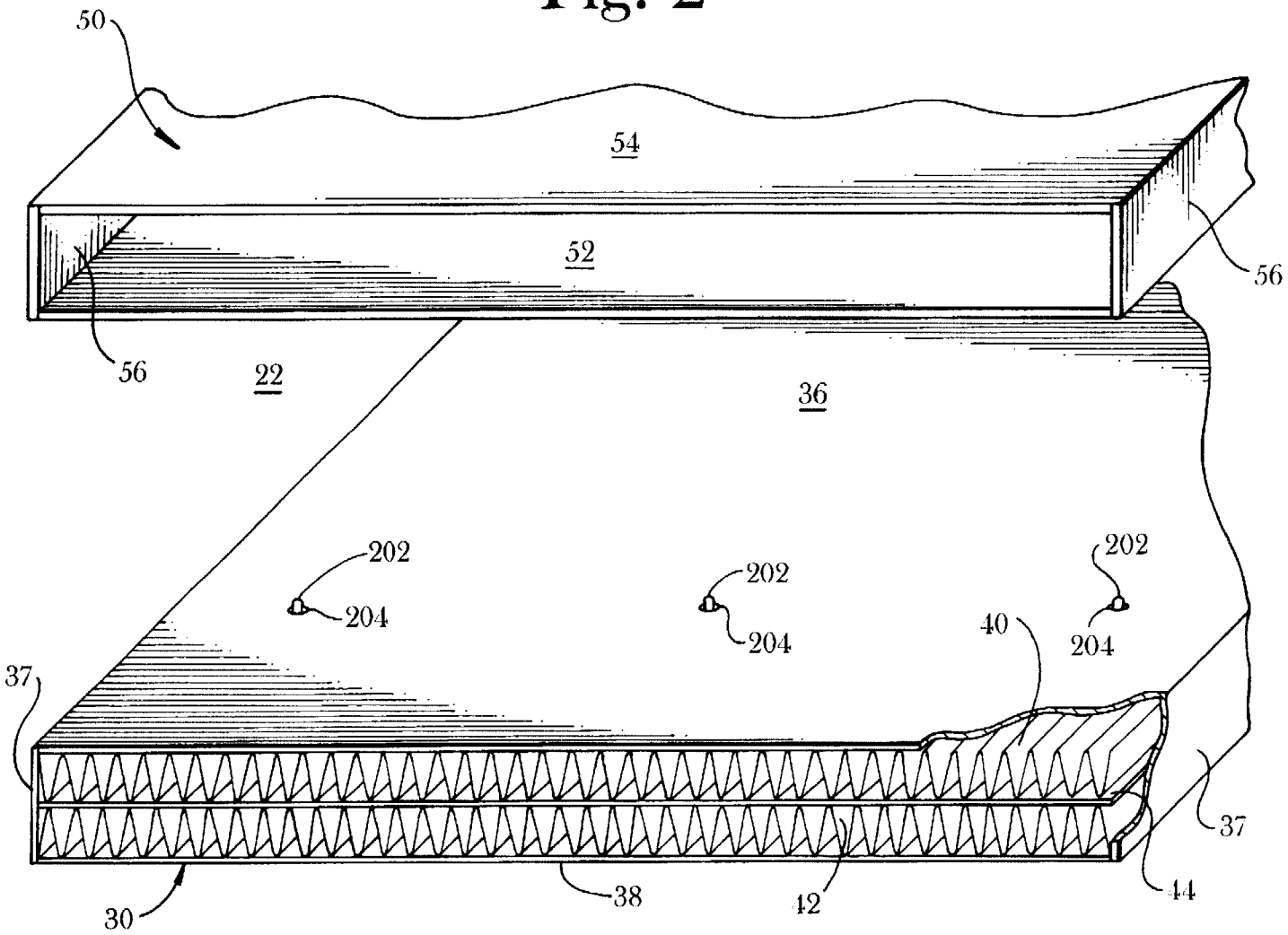
FIG. 2 is a schematic cross sectional perspective view taken along the line 2—2 in FIG. 1.

The structure of the lower and upper ducts (30 and 50, respectively) is best seen in FIG. 2. The lower duct generally comprises an inner panel 36, an outer panel 38 and a pair of side walls 37, which together generally define an enclosure through which air may pass. The inner panel defines the bottom of the oven cavity 22 and, as described below, provides a surface on which a work piece may rest during the heat treatment process.

The lower duct desirably includes a heat exchanger therein to improve the rate of heat transfer between the inner panel 36 and the air flowing through the duct. This heat exchanger can take any suitable form, but is desirably constructed so that it will not unduly hamper air flow through the duct yet will provide a substantial surface area for contact with the air flowing through the duct.

In the embodiment schematically illustrated in FIG. 2, the lower duct includes a pair of corrugated metal sheets 40, 42 separated by an internal sheet 44. The corrugated metal sheets are desirably oriented so that they define a plurality of channels through which air may flow, the channels being oriented to extend generally from the inlet end of the lower duct to its outlet end (32 and 34, respectively, inn FIG. 1). The use of the corrugated and internal sheets will significantly increase the surface are with which the air flowing through the lower duct comes into contact, greatly improving the rate of heat transfer from the air to the lower duct and its internal panel 36.

If so desired, the upper corrugated sheet 40 may be welded to the bottom of the inner panel 36 and the top of the internal sheet 44 and the lower corrugated sheet may be welded to the bottom of the internal sheet and the top of the outer panel 38. This will provide structural integrity of the lower panel and, more importantly, help improve the rate of heat transfer between the respective parts of the duct 30.

The upper duct 50, however, desirably does not include any such heat exchanger. Instead, the upper duct is constructed to permit air to flow therethrough relatively freely. In the embodiment shown, the upper duct 50 simply comprises an inner panel 52, an outer panel 54 and a pair of opposed sidewalls 56 which serve to enclose the air flowing through the duct 50. This will improve the air flow through the upper duct 50, as compared to the lower duct 30 with its heat exchanger, and help reduce the pressure drop between the inlet end of the lower duct and the outlet end of the upper duct. Although this will tend to reduce the rate of heat transfer between the upper duct and the air flowing through the duct, at least as compared to that of the lower duct 30, for reasons described below this heat transfer rate is less critical than the heat transfer rate of the lower duct.

The air recirculation loop, namely the ducts 30, 50, the conduit 60 and the blower 70, is desirably substantially entirely enclosed to, ideally, completely seal the air within the loop from the rest of the heating chamber 20. In some applications, relatively small leaks in the air recirculation loop may not create any problems more substantial than a loss of efficiency of the oven. In some applications, though, such as in manufacturing some types of electronic components which are sensitive to oxygen at higher temperatures, the presence of air in the heating chamber can be particularly problematic. In such circumstances, it may be desirably to maintain a relatively inert atmosphere in the oven cavity 22.

For such applications, a relatively well-sealed oven cavity 22 can be achieved by sealingly abutting the lower duct 30, upper duct 50 and conduit 60 against the front and rear walls of the heating chamber 20. A door for placing work pieces in the cavity can be provided, but the opening of the door desirably does not extend beyond the periphery of the cavity so that a permanent seal between the walls of the chamber 20 and the air recirculation loop can be maintained. The cavity can be supplied with a relatively inert gas, as schematically illustrated in FIG. 1 by the tank of gas 80 and supply conduit 82. For most electronic component manufacturing operations, for example, nitrogen gas should provide a suitable atmosphere. In order to minimize the influx of any contaminating or reactive gases into the cavity 22, a positive pressure of the inert gas can be maintained in the cavity.

The materials of which the ducts 30, 50 and the conduit 60 are formed can be varied depending on the conditions in which they are intended to be used. The materials should obviously be stable at the anticipated temperature of use of the oven 10 and should not react with or contaminate the work pieces to be treated. In order to maintain operational efficiency of the oven, the ducts should be formed of a material which exhibits good thermal transfer properties. For most applications, a suitable metal, such as stainless steel or aluminum, would probably be used.

For a given oven construction and air supply temperature, the flow rate of the air passing through the air recirculation loop will dictate the speed with which the temperatures of the inner panels 36, 52 of the lower and upper ducts will change. In order to reduce the cycle times for heat treatments performed in the present oven, therefore, the flow rate should optimally be maintained relatively high. For example, in one test which enabled the oven to generate a heating rate of about 50° C. per minute, the lower duct 30 and upper duct 50 were each about one half meter by one half meter in surface area with a thickness (inner panel to outer panel of each duct) on the order of about 2.5 cm and the flow rate of air passing through the ducts was about 350 standard cubic feet per minute (SCFM) (about 10 cubic meters per minute at room temperature).

The oven 10 obviously needs a means to supply heating and cooling air to rapidly heat and cool the ducts and work pieces placed in the oven cavity 22. Although a heater can be built into the air recirculation loop, the embodiment of the invention illustrated in FIG. 1 employs a separate air supply contained in a separate air supply chamber 100, as noted above.

The air supply chamber 100 shown in FIG. 1 employs a blower 110 for continuously recirculating air within the chamber 100 and a heater 112 for heating the air. Depending on the maximum temperature at which the oven 10 will ordinarily be operated, the heater can be of any useful type, such as an electrical resistance heater, a natural gas heater or the like.

The air in the chamber 100 is desirably maintained at a relatively constant elevated temperature by recirculating the air in the chamber 100 past the heater. This temperature is desirably at least as high as the maximum heat treatment temperature to be achieved in the oven cavity 22, and is desirably significantly higher to reduce the time necessary to achieve the desired heat treatment temperature. By controlling the proportion of heated air and ambient air, as detailed below, the temperature of the air provided to the blower 70 of the heating chamber 20 can be accurately controlled at a level below the temperature of the air in the air supply chamber 100.

Air is supplied to the blower 70 through an air supply conduit 120 and air may be vented to atmosphere through a venting stack 140 after it passes through the upper duct 50. The air supply conduit 120 has an inlet end 122 which is in communication with ambient air and an outlet end 124 in communication with a blower supply duct 72 disposed between the end of the upper duct 50 and the blower 70. Heated air is introduced into the conduit 120 through the hot air inlet 126, which may be positioned adjacent the exit of the blower 110. By controlling the relative positions of the hot air valve 128 and the ambient air valve 130, the temperature of the air delivered to the blower 70 of the heating chamber can be accurately controlled.

The venting stack 140 also has an inlet end 142 and an outlet end. The inlet end 142 is desirably positioned immediately upstream of the outlet end 124 of the air supply conduit 120 along the blower supply duct 72. If the gas exiting the oven 10 is not too hot, the outlet end 144 of the venting stack can simply discharge used air into the atmosphere. If the air is warmer, though, excess heat can be recovered from the gas in a variety of manners, including redirecting the air back into the flow of the air supply chamber 100 through a make-up air supply tube 146. The relative proportions of the air directed to the atmosphere and the air redirected into the air supply chamber 100 can be controlled in any suitable fashion.

FIG. 1 schematically illustrates one preferred system for controlling these proportions. In particular, there is an air return valve 148 and a venting valve 150 which can be controlled to direct the flow of air in the venting stack as desired. If the air return valve is fully closed and the venting valve is fully opened, essentially all of the air will be vented to the atmosphere. If the air return valve is fully opened and the venting valve is fully closed, essentially all of the air will be returned to the air supply chamber 100. At intermediate positions between these endpoints, the relative proportions of the air vented to atmosphere and the air returned to the air supply chamber can be controlled.

It is contemplated that the air return valve 148 will be open sufficiently to supply all of the air needed to make up for air delivered to the heating chamber 20 from the air supply chamber 100 through air supply conduit 120. When one wishes to heat the system as quickly as possible, the ambient air valve 130 and venting valve 150 will be closed and the hot air valve 128 and air return valve 148 will be open. This will deliver heated air from the air supply chamber 100 without any admixture of cooler ambient air and will return somewhat preheated air to the air supply chamber for reheating, conserving energy. When maximum cooling are desired, these positions are desirably reversed, with valves 130 and 150 being fully open and valves 128 and 148 fully closed. This will direct undiluted ambient air to the heating chamber and also conserves energy by avoiding any need to heat additional volumes of air in the air supply chamber.

In a preferred embodiment, the rate at which air enters and exits the air recirculation loop in the heating chamber 20 is controlled by three valves, 160, 162 and 164, which are controlled in unison. A main flow control valve 160 is positioned in the blower supply duct 72 between the inlet 142 of the venting stack and the outlet 124 of the air supply conduit. This valve helps determine what proportion of air exiting the upper duct 50 is returned to the blower 70—when the valve is fully open, essentially all of the air may be returned to the blower while closing the valve will divert essentially all of the air through the venting stack 144.

An air inlet valve 162 may be positioned adjacent the outlet 124 of the air supply conduit while an air outlet valve 164 may be placed adjacent the inlet end of the venting stack. These valves are optimally operated in unison with the main flow control valve 160, but are opposed to the position of the main valve, i.e. these valves 162, 164 are closed when the main valve 160 is open and open when the main valve is closed. These valves 162, 164 also desirably track the relative position of the main valve 160 between these two end points.

When the oven cavity is to be maintained in a steady state, the main valve 160 may be held in its fully open position and the other two valves 162, 164 may be in their respective closed positions, permitting the air to recirculate through the air recirculation loop. If it is necessary to heat or cool the oven cavity, the main valve may be closed and the other two valves may be opened, with the degree to which the valves are opened or closed depending at least in part on the rate at which heating or cooling is desired.

For example, for maximum heating rate, the main valve 160 will be in its closed position and both the air inlet valve 162 and air outlet valve 164 will be in their open positions, while the hot air valve 128 is in its open position and the ambient air valve 130 is closed. This will allow the maximum flow rate of preheated air from the air supply chamber 100 to pass through the ducts 30, 50. When the maximum cooling rate is desired, the main flow control valve 160, air inlet valve 162 and air outlet valve 164 will be in the same position, but the relative positions of the hot air valve 128 and ambient air valve 130 will be reversed, maximizing the rate of relatively cool ambient air through the same ducts.

An oven 10 in accordance with the present invention can be used to rapidly heat and cool any desired workpiece. The system is particularly well suited, though, for relatively thin substrates such as those encountered in the manufacture of electronic components and multi-layer film structures. The workpieces may be positioned anywhere in the oven cavity, such as stacked on shelves, but this is not preferred. Instead, the workpieces are optimally placed directly on the inner panel 36 of the lower duct 30 and are supported thereby.

Placing the workpieces in direct contact with the lower duct 30 permits a majority of the heating of the substrate to be accomplished by conductive transfer of heat from the duct 30 to the workpiece. The upper duct 50 will help maintain a controlled temperature environment within the oven cavity 22 and can contribute to heating of the workpieces by both convection and radiant heating, but conductive heating is minimal due to the fact that there is little or no physical contact between the upper duct and the workpieces.

This takes advantage of the structure of the present oven by maximizing heat transfer to the lower duct 30 by employing a heat exchanger, as detailed above in connection with FIG. 2. Since the heating and cooling effects of the upper duct 50 are less pronounced, maximizing air flow through the upper duct by allowing air to flow relatively freely therethrough (e.g. omitting a heat exchanger) will help maximize flow rate of air through the system. Accordingly, at a given air pressure generated by the blower 70, more heated or cooler air can be passed through the lower panel and over its heat exchanger to increase the heating and cooling rate of the workpieces.

It should be understood that the terms "lower" and "upper" are applied relatively arbitrarily in this description and are intended primarily to refer to an oven configured as illustrated in FIG. 1. If so desired, for example, the illustrated oven can be inverted such that the "lower" duct 30 is above the "upper" duct 50 without departing from the scope of the present invention. This may not have the advantages outlined immediately above arising from simply resting the workpieces directly on the inner panel 36 of the "lower" duct, but it may still be advantageous for other reasons in certain circumstances.

In many circumstances, the workpieces to be treated can be fairly readily handled by placing them directly on the inner panel 36 of the lower duct and simply removing them after heat treating. For some thin substrates which may be sensitive to contamination or physical damage if their upper surfaces or sides are touched during the loading and unloading process, though, an oven of the invention desirably includes lifting pins for temporarily supporting the workpieces when the are being loaded into the cavity 22 and for lifting the workpieces off of the lower duct for removal from the oven. This permits an operator or automated handling equipment to lift the workpieces out of the oven by the bottoms of the workpieces without worrying about damaging the workpieces.

Figure 3:
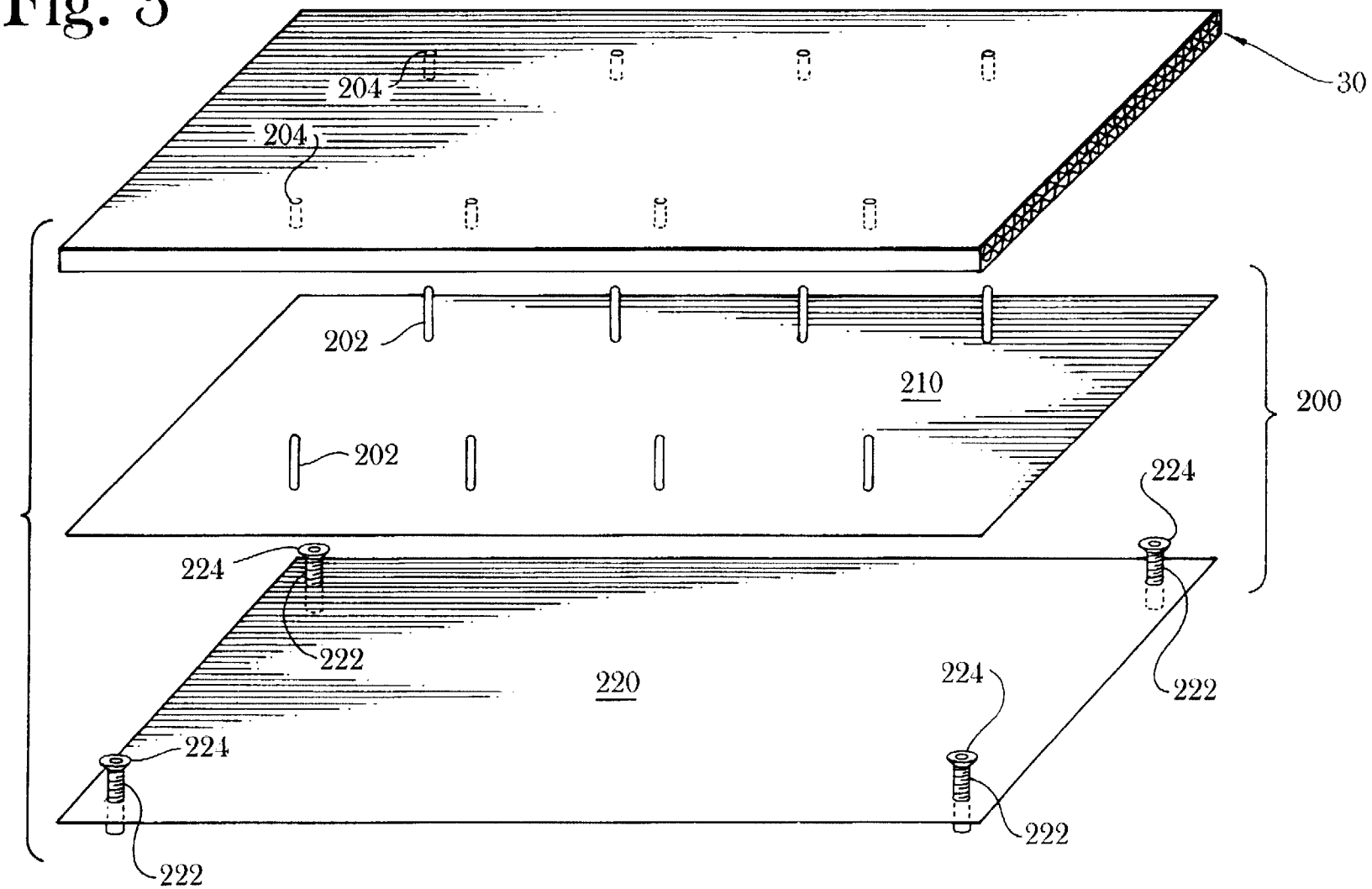
FIG. 3 is an exploded isolation view of a portion of the oven illustrated in FIG. 1 showing a lifting pin actuator of the invention.
Figure 4:
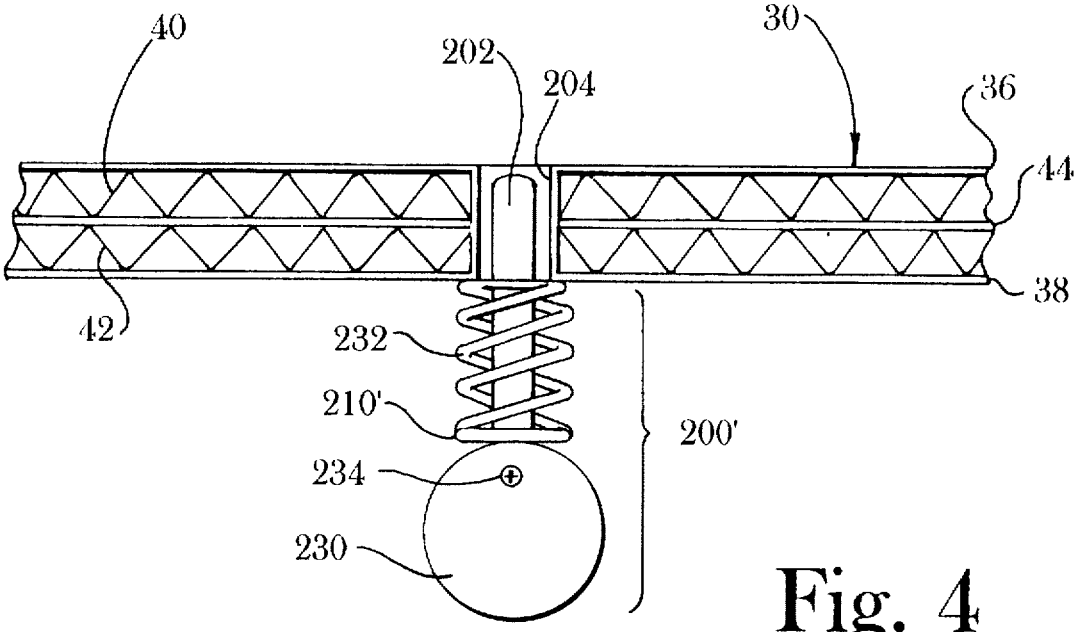
FIG. 4 is a schematic view in partial cross section showing an alternative embodiment of a lifting pin actuator of the invention.
Figure 5:
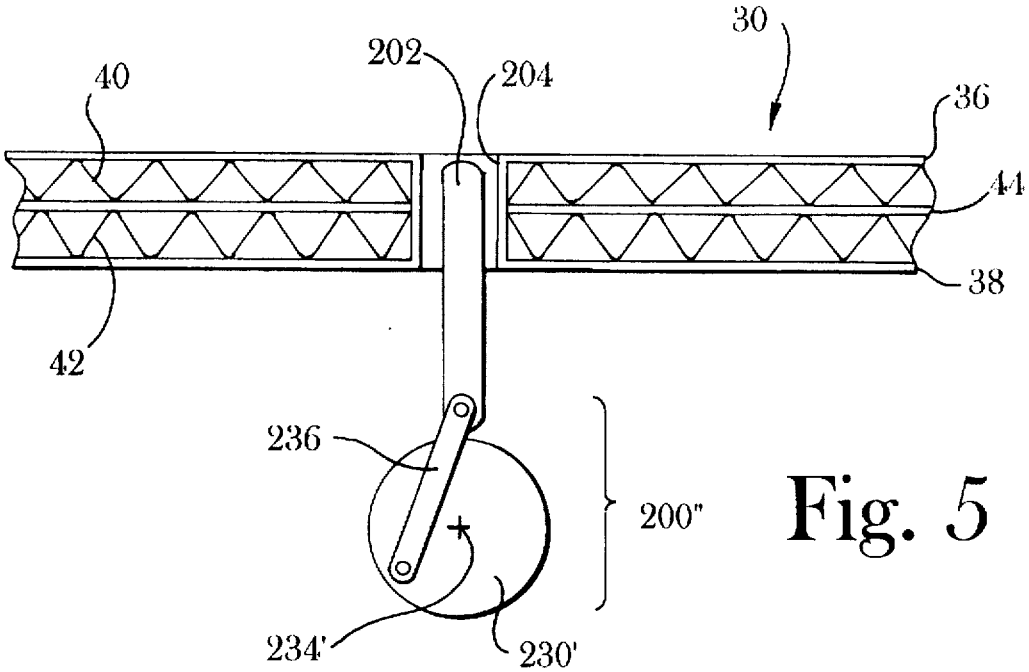
FIG. 5 is a schematic view in partial cross section showing another embodiment of a lifting pin actuator of the invention.

FIGS. 3–5 show three alternative embodiments of lifting pins and their associated actuators for use in connection with an oven of the invention. Turning first to FIG. 3, the lifting pin actuator 200 includes a pin-carrying plate 210 and a mounting plate 220. The pin-carrying plate 210 includes a plurality of pins 202 extending generally perpendicularly upwardly from it upper surface. In the embodiment shown, there are eight pins arranged in two generally parallel rows. The number and arrangement of the pins on this plate 210 can be varied, though, to accommodate differences in the workpieces to be treated, the handling equipment to be used with the workpieces, and other such factors. For example, the embodiment illustrated in FIG. 2 has three pins extending laterally across the panel rather than the two pins which would be provided by the version of FIG. 3.

The pins are arranged on the carrying plate 210 to be received in pin-receiving holes 204 passing through the lower duct 30. As shown in FIG. 2, the pins should be long enough so that when they are in their upper position they extend upwardly through the lower duct and protrude above the inner panel 36 of the lower duct. In this manner, the pins can contact the bottom of a workpiece resting on the lower duct and lift it off of the inner panel 36 so that the handling equipment can engage the lower side of the workpiece, such as by having one of a pair of parallel flanges (not shown) extend underneath the workpiece so that it can be lifted out of the oven.

As suggested by FIGS. 4 and 5, the pin-receiving holes 204 are desirably sealed to substantially limit the egress of gas from within the duct 30 into the oven cavity 22. Although this may not be particularly critical in some embodiments, in others this can be particularly helpful. For example, if the oven 10 is to be used to treat an oxygen-sensitive electronic component, the oven cavity can be maintained with an overpressure of nitrogen or another anaerobic gas. As the heated gas (usually air) passing through the ducts 30, 50 will usually be under pressure, though, this may not be sufficient to prevent damage to the components from air entering the oven cavity through the holes 204. In such circumstances, the ports may need to be enclosed to effectively prevent air from escaping from the lower duct through the ports.

Turning back to FIG. 3, the pin carrying plate 210 is supported by at least one actuating shaft 222. In the embodiment shown, a mounting plate 220 is positioned beneath the carrying plate 210 and supports four such actuating shafts 222 at locations adjacent the four corners of the carrying plate. In the embodiment shown, the actuating shafts are threaded along at least a portion of their lengths and these threads mate with internal threads in holes passing through the mounting plate. If so desired, the tops of the shafts may be provided with bearing rings 224 which engage and support the bottom of the carrying plate.

As the shafts 222 are turned, they will move axially with respect to the mounting plate 220, effectively raising or lowering the carrying plate 210 with respect to the mounting plate. By keeping the mounting plate stationary with respect to the lower duct 50 and coordinating the movement of the shafts 222, such as by turning all of the shafts using a single motor and a belt or by synchronizing individual stepper motors attached separately to the shafts, one can raise or lower the pins within the holes 204 in the lower duct.

FIGS. 4 and 5 illustrate alternative embodiments of pin actuating systems (200' and 200", respectively) for use with the present invention. In FIG. 4, each pin is attached at its lower end to a pin carrying plate 210'. Although all of the pins may be attached to a common pin carrying plate 210 as in FIG. 3, this is not necessary and in this embodiment each pin may instead be attached to separate carrying plates 210' which can move independently of one another.

The pin carrying plate 210' extends radially outwardly of the bottom of the pin 202 to define a generally annular shoulder against which one or more compression springs 232 can bear. The tops of the compression springs rest against the outer panel 38 of the lower duct, biasing the pin downwardly in FIG. 4. The pin carrying plate 210' is engaged by an actuating cam 230 to control the position of the pin 202. In the embodiment shown, the actuating cam is generally circular in cross section and is eccentrically mounted to rotate about an axis 234 spaced from the center of the cam. As the cam rotates, the pin is raised or lowered because the distance between the cam's axis of rotation and the pin carrying plate 210' will change.

In the pin actuating system 200" of FIG. 5, the pins 202 are each connected to an actuating cam 230' by an elongate link 236. The cam 230' may rotate about its center 234', but one end of the link 236 is pivotably attached to the cam at a location spaced away from that center 234'. By connecting the other end of the link to the pin 202, when the cam 230' is rotated, the attached pin will be raised or lowered.

In the embodiments which in FIGS. 4 and 5, more than one pin can be actuated by a single cam shaft. For example, an elongate cam (extending through the plane of the drawings) can control two or more aligned pins. This will help ensure that the pins will act together in raising or lowering the workpiece in the oven cavity 22. A plurality of such cams may need to be employed, but they may all may be driven from a common motor or a series of synchronized motors, as discussed above in connection with the motors driving the shafts 222 in FIG. 3.

While a preferred embodiment of the present invention has been described, it should be understood that various changes, adaptations and modifications may be made therein without departing from the spirit of the invention and the scope of the appended claims.

What is claimed is:

1. A radiant panel oven for rapidly heating and cooling a workpiece, comprising:

a. a first duct defining an initial leg of an enclosed air flow path and having an inner panel, a heat exchanger, and at least two selectively actuatable lifting pins; the first duct having an inlet end and an outlet end, the inlet end being connected to a temperature-controlled air supply; the lifting pins being received in ports formed through the entire thickness of the first duct and being adapted to lift a workpiece upwardly off of the inner panel; wherein said pins are received in ports formed through the entire thickness of the first duct; and b. a second duct defining a final leg of the enclosed air flow path and having an inner panel spaced from the inner panel of the first duct to define an oven cavity therebetween; and c. a connecting conduit connecting the outlet end of the first duct to the second duct and defining an intermediate leg of the enclosed air flow path.

2. The oven of claim 1 wherein the ports are enclosed to effectively prevent air from escaping from the first duct through the ports.

3. The oven of claim 1 further comprising a lifting system connected to the pins for synchronously raising the pins together.

4. The oven of claim 3 wherein the lifting system comprises a lifting plate, each of the pins being connected to the lifting plate.

5. The oven of claim 1 wherein each of the pins is attached to a lifting cam which can raise a pin when the lifting cam is rotated.

6. The oven of claim 1 wherein the first duct further comprises an outer panel, the outer panel being spaced from the inner panel, the heat exchanger comprising a corrugated sheet disposed between the inner and outer panels and defining a plurality of air flow paths extending from the inlet end to the outlet end of the first duct.

7. The oven of claim 1 wherein the second duct further comprises an outer panel and a pair of opposed side panels, the inner, outer and side panels defining an open chamber through which air may flow freely.

8. The oven of claim 1 further comprising a blower in communication with at least one of the first and second ducts, the first duct, the connecting conduit, the second duct and the blower together defining the enclose air flow path.

* * * * *